United States Patent [19]

Patton

[11] Patent Number: 4,711,058

[45] Date of Patent: Dec. 8, 1987

[54] INSULATED CONCRETE FORM

[75] Inventor: Edward J. Patton, Murrieta, Calif.

[73] Assignee: Ahamco Investments, Inc., Rancho California, Calif.

[21] Appl. No.: 864,999

[22] PCT Filed: Jun. 11, 1984

[86] PCT No.: PCT/US84/00924

§ 371 Date: Feb. 6, 1986

§ 102(e) Date: Feb. 6, 1986

[87] PCT Pub. No.: WO86/00101

PCT Pub. Date: Jan. 3, 1986

[51] Int. Cl.[4] ..... E04B 1/72

[52] U.S. Cl. ..... 52/101; 52/169.11

[58] Field of Search ..... 403/382, 403, 231; 52/169.11, 169.12, 274, 264, 265, 101; 249/3–7

[56] References Cited

U.S. PATENT DOCUMENTS

| | | | |
|---|---|---|---|
| 1,796,959 | 3/1931 | Raynor | 52/358 |
| 2,137,767 | 11/1938 | Betcone | 52/274 |
| 2,678,482 | 5/1954 | Cuthbertson | 249/6 |
| 4,335,548 | 6/1982 | Rehbein | 52/169.11 |
| 4,409,766 | 10/1983 | Blackmore | 52/169.11 |
| 4,524,553 | 6/1985 | Hacker | 52/169.11 |

FOREIGN PATENT DOCUMENTS

| | | | |
|---|---|---|---|
| 2420003 | 11/1979 | France | 52/309.17 |
| 983471 | 2/1965 | United Kingdom | 403/382 |

*Primary Examiner*—Henry E. Raduazo

*Attorney, Agent, or Firm*—Albert O. Cota

[57] ABSTRACT

A concrete form consisting of a metallic sheath (20) having a front (22), top (24), back (26), and an angular locking flange and bug barrier (28) nesting over an insulated barrier (30). The sheath (20) is permanently attached to the barrier (30) with a heating adhesive material (31) set by rotatably compressing the assembly between two rollers. Corners are made by notching the sheath (20) on one of the sides and adding a metallic corner splice angle (32). Longitudinal splice joints utilize a straight splice angle (34) inserted between the sheath (20) and barrier (30), where the two ends butt together. Conventional prepositioned wooden stakes (36) are held tightly against the outside surface of the concrete form with wire form clips (38). A metallic sill plate (40) may be added to the structure after the concrete has been poured into the form and hardened. Only the stakes (36) and clips (38) need to be removed, as the remainder of the form becomes an integral part of the floor structure.

3 Claims, 11 Drawing Figures

INSULATED CONCRETE FORM

TECHNICAL FIELD

The invention relates to building structures, in general and more specifically to concrete forms used in construction of slab floors and stem wall insulation.

BACKGROUND ART

The current method used for constructing concrete slab floors is to initially set into the ground a plurality of wooden stakes around the outer periphery of the unpoured slab. A reusable wood form is next attached to the stakes by means of nails or screws. To the inside surface of the form is placed an insulation barrier that is attached to the forms by means of an adhesive and/or special nails. After the composite form is securely in place, the concrete slab is poured.

Once the concrete slab has set and hardened, the wood form is manually removed from the insulation barrier and the stakes. The exposed insulation barrier is then covered with a metal sheath that is placed over the top of the barrier.

A search of the prior art did not disclose any patents that directly read on the claims of the instant invention. However, the following U.S. patents were considered related:

| U.S. PAT. NO. | INVENTOR | ISSUED |
|---|---|---|
| 4,340,200 | Stegmeier | 20 July 1982 |
| 4,141,532 | Wall | 27 February 1979 |
| 4,027,846 | Caplat | 7 June 1977 |
| 3,016,225 | Hughes | 9 January 1962 |

The Stegmeier patent approaches the problem of holding a form board in place to a support stake with a U-shaped spring clip. This clip contains fingers to grasp the top and bottom edge of the form while applying pressure to a round stake. The clip is in two separate pieces one to attach to the board and the other to apply spring pressure to the stake.

The Wall patent discloses an extruded U-shape frame that is cast integral with the edge of a flat concrete building panel and becomes the edge molding for attachment to a wall. Connecting means are incorporated into this molding with corner frame members completing the structure.

The Caplat patent utilizes a panel for casting concrete walls. The panel has steel sheets on the front and rear and rigid polyurethane foam cast in situ between the panel walls. The utility lies in weight and self-heating of the concrete in that the low thermal conductivity permits the heat generated in curing to be retained permitting a rapid setting of the concrete. The panel is removed when the concrete is set.

The Hughes patent discloses an attaching lever to retain a form and lock it into place with an over center cam-lock lever compressibly holding a hollow stake. A support channel contains top and bottom flanges that retain the wooden form and the attaching lever.

For background purposes and as indicative of the art to which the invention relates, reference may be made to the following U.S. patents:

| U.S. PAT. NO. | INVENTOR | ISSUED |
|---|---|---|
| 4,022,437 | French | 10 May 1977 |

-continued

| U.S. PAT. NO. | INVENTOR | ISSUED |
|---|---|---|
| 3,595,515 | Rollow | 27 July 1971 |
| 2,741,821 | Findley | 17 April 1956 |

DISCLOSURE OF THE INVENTION

Costs involved in constructing inhabital structures has increased considerably, therefore, the need to reduce materials costs and provide methods to reduce manpower requirements has become an important factor in the building trade. Also, when constructing a slab floor certain government regulations have required an insulation barrier and protective metal covers to be added in critical areas in order to conserve energy. The addition of these requisite items is cosly and labor intensive. Therefore, it is the primary object of this invention to provide a concrete form that has sufficient structural integrity to preclude the use of wood forms entirely and incorporate the insulation barrier and metal protective cover in a single and permanent structure. Previously, slab floors, as well as stem wall insulated construction, required wood forming using a 2×8, 2×10, or 2×12 (41.3 mm wide ×193.7 to 295.3 mm high) board. These wood boards would be positioned around the periphery with stakes driven into the ground and nailed partially through to hold them in place during the pouring and hardening process.

The fact that no labor is required to strip out the forming after casting is indeed an important object, as the instant invention allows the forming to stay in place once the concrete has been poured. Stripping by hand requires pulling the nails from the stakes then removing them from the ground and carefully breaking the wood itself away. Further, cleaning and storage, plus transportation to the next job site all requiring considerable manual labor to accomplish.

Another object of the invention includes the application of a reusable wire form stake clip to hold the stake to the concrete form eliminating the need for nails completely. The use of this novel stake clip allows an expedient and simplified form laying technique where wood stakes are initially and conventionally positioned around the outer periphery of the unpoured slab. After the stakes are in place the insulated concrete form is laid against the inner side of the stakes and the stakes are easily locked to the form by means of the stake clip.

Prior art utilizes a separate temporary attachment of the required insulation to the wood form by nailing, stapling, or glueing the insulation to the wood as previously discussed. The slab is then poured and when the wood form is taken off, extreme care is used to not damage the surface so attached. Further, it is necessary to add a metal protective cover over the insulation so that it extends below grade and attaches to the structure above the concrete slab. It is, therefore, still another object to eliminate this step completely as the invention in the preferred embodiment includes all of these procedures prior to installation completed at a convenient location where the insulation is bonded to the metallic protective sheath and then handled as an integral component.

Yet another object allows flexibility of shape of the footing, as the lengths may be easily cut with a portable electric saw with a rotating blade. Right angle joints are also easily made by notching the metal on one side of the joint and adding a corner splice angle between the insulation and the metal. Similarly, butt joints are formed by positioning the form end to end and adding a metallic splice angle in the same manner.

The final object allows all of the requisite government statutory requirements to be satisfied, such as Title 24 of the California Energy Commission, a state law requiring energy conservation in residential building. These requirements specify the need for the insulation along with a minimum "R" factor (heat transfer coefficient) which the invention completely adheres to in its entirety.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
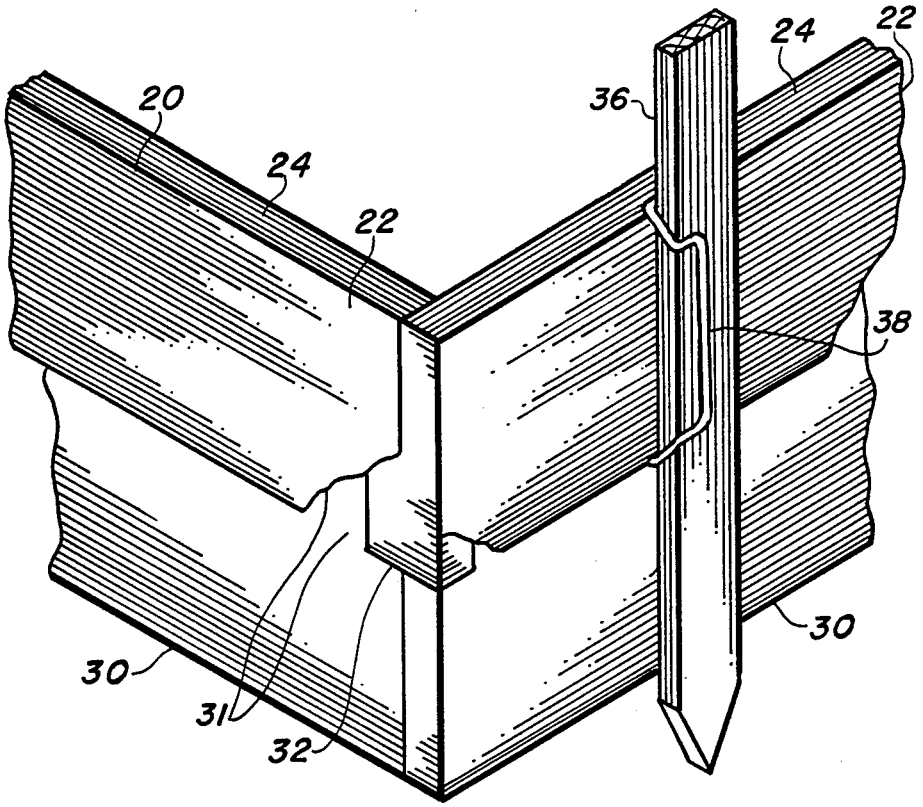
FIG. 1 is a partial isometric view of the corner of the preferred embodiment with the protective sheath partially cut-away for clarity.
Figure 2:
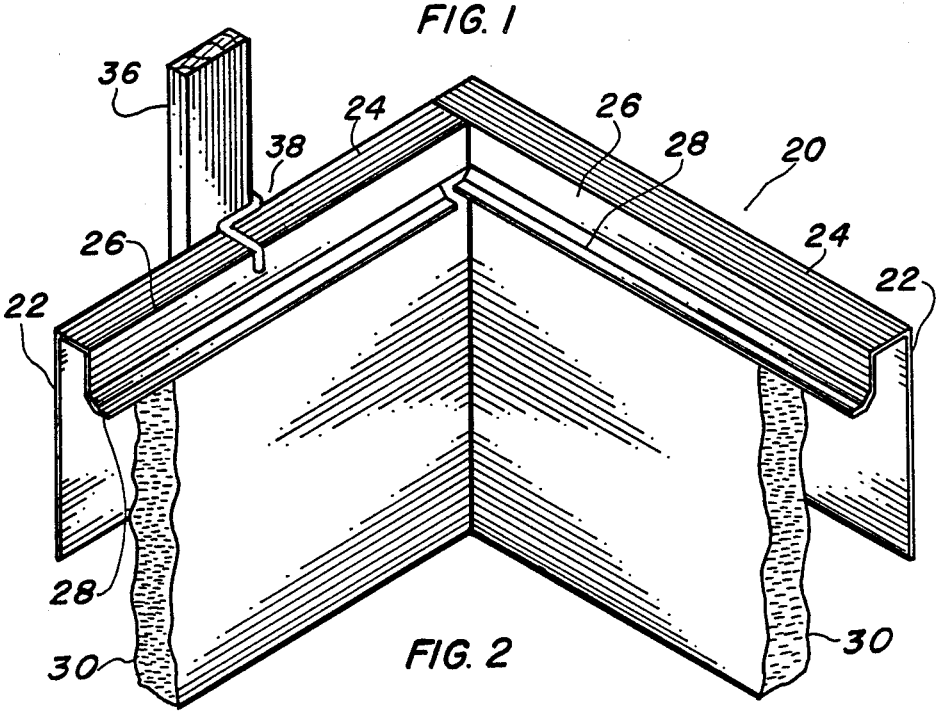
FIG. 2 is a partial isometric view of the corner shown from the side opposite FIG. 1.
Figure 3:
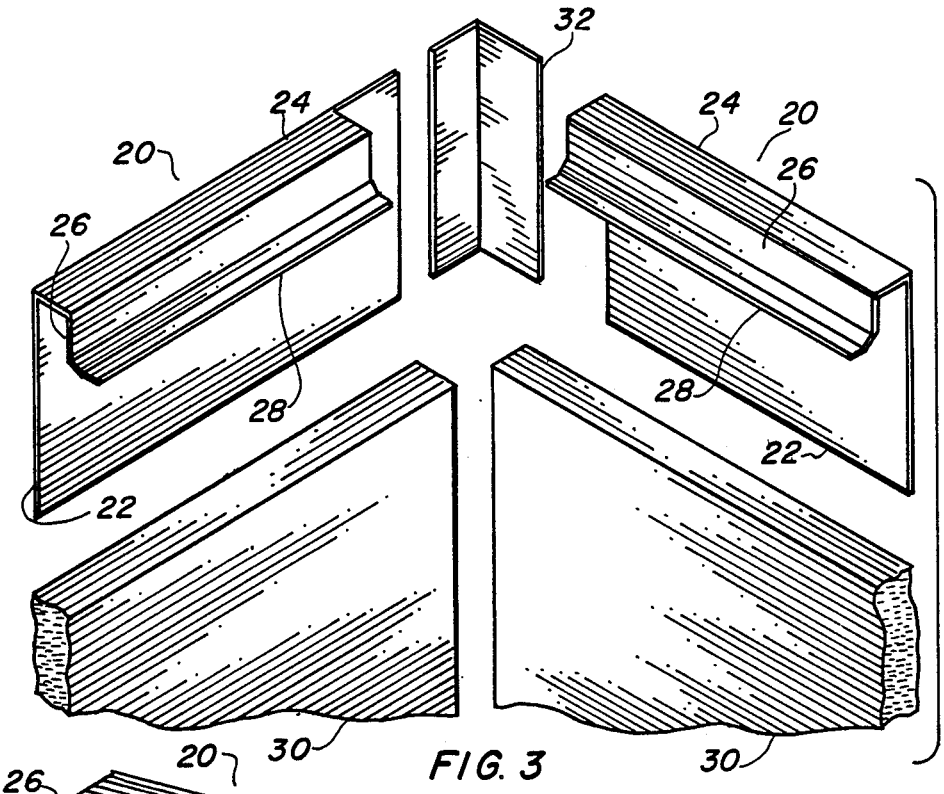
FIG. 3 is an exploded partial isometric view of the corner as shown in FIG. 2.
Figure 4:
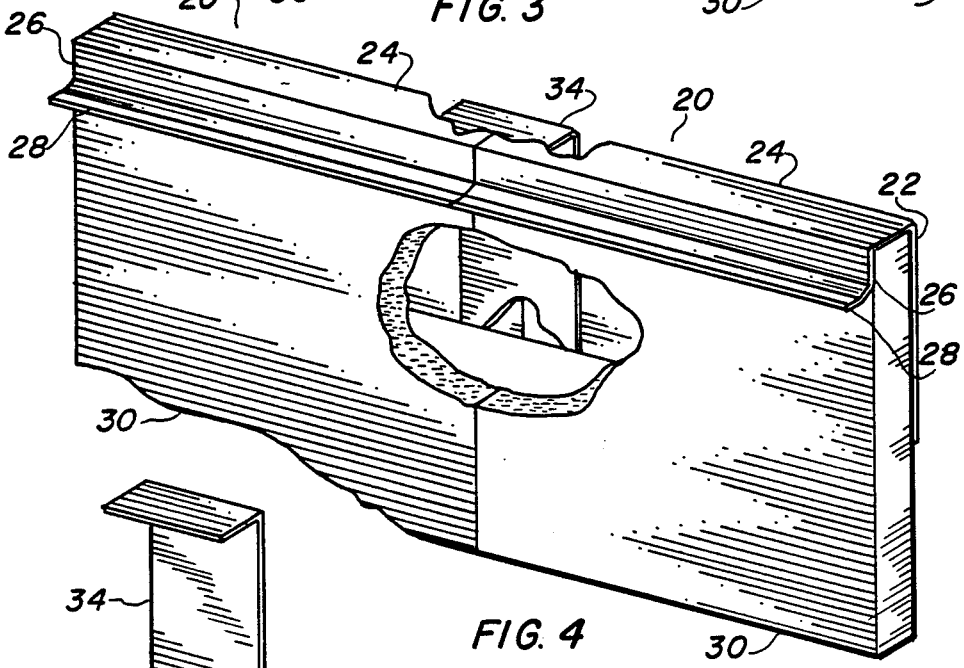
FIG. 4 is a fragmentary view in partial isometric of the invention at a butt joint cut-away to depict the splice angle inserted between the sheath and the block foam.
Figure 5:
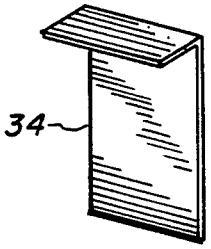
FIG. 5 is a partial isometric view of the straight splice angle removed entirely from the assembly.

Referring now in detail to the drawings and describing the preferred embodiment, the invention comprises a self-contained insulated form for concrete having a metallic protective sheath 20 in linear shape. The sheath 20 is formed from sheet metal angularly broken into a configuration having a vertical front leg 22, a horizontal top 24, a vertical back 26 and an angular locking flange and bug barrier 28, as shown in FIGS. 1–4. The sheath 20 is formed of metal, such as hot or cold rolled steel, or sheet aluminum. A low carbon grade of rimmed, capped steel or semi-killed steel preferred, and a uniform layer of zinc applied by an electro-plated process. Painted or hot dipped galvanized surface treating is also acceptable. The steel with either a heavy or flash coating of zinc allows the paint to adhere without costly cleaning and surface preparation. It has been found that Republic Steels material known by its registered trademark "PAINTLOK" in 26 gauge, 0.040 inches (1.016 millimeters) is an ideal material to use. In practice, the sheath is formed by slitting the material from a roll, flattening and forming in sections in a press brake creating a structural member of a length easy to handle.

An insulated barrier 30 nests into the protective sheath 20. This barrier 30 is made of rigid block foam insulation in linear rectangular shape and has a front, back, top, and bottom. The length of this barrier 30 is exactly the same as the sheath 20 and is perhaps twice as high as the sheath vertical front leg 22. The width is the same as the inside of the sheath top 24 and back 26 allowing a tight fit when nested together. The barrier 30 is formed of a rigid block foam insulating material, such as polyurethane foam in the closed cell formulation, or cellulose acetate, phenolics or urea formaldehyde. Polyvinyl chloride in the styrene acrylonitrile type may also be utilized with polystyrene being preferred, best known by its registered trademark "STYROFOAM". This material is well known in the art and is molded from expandable beads into rigid finished boards. When nested together with the sheath 20, the barrier 30 is partially contiguous on the front to the sheath front leg 22, also on the top to the sheath horizontal top 24 and the upper portion of the back to the sheath back 26, all being in intimate contact with their respective mating surfaces.

An adhesive material 31 bonds the sheath 20 to the insulation 30. This elastomeric material may include blends of natural rubber Buna-N or resin, such as phenolic-butadiene-acrylonitrile rubber with an elastomer known by its registered trademark "STAVON" in the formulation T440 RED being preferred. This adhesive material is preheated and sprayed on both the inside surface of the sheath 20 and the insulation barrier 30 and joined together while still in the liquified state. The entire assembly is then placed between two rollers the exact shape of the material and rotatably compressed to set fast the adhesive therebetween.

When thus assembled, the form becomes a rigid member that is easily handled and transported to the job site.

A corner is made, at any angle, by notching the sheath top 24 and the back 26 the same distance as the width of the assembly when placed at right angles to an unnotched form. The angular locking flange 28 is notched somewhat deeper allowing clearance for its counterpart. When the notched and unnotched forms are angularly together the entire outside surface is covered with metal without overlapping or exposing the insulated barrier 30. To secure this joint a metallic corner splice angle 32 is utilized. This splice angle 32 has two flat surfaces and is broken on the length forming a corner. The height of the splice angle 32 is the same as that of the leg 22, but shorter in length, and is installed by forcing each flat surface into the glued interface between the sheath vertical leg 22 and the insulated barrier 30. This forceable entry tears away the glue from the joint, however, sufficient compression is left to maintain the integrity of the junction. This corner construction further acts as structural reinforcing and completely seals the apex of the corner.

A splice joint for a long run of form is similarly constructed with the ends of the insulated concrete forms butted together in linear alignment. A metallic straight splice angle 34 having a top leg and a vertical leg are likewise inserted into the interface of the top 24, the front leg 22, and the barrier 30. The top leg of the splice angle 34 is the same length, or shorter, than inside of the barrier top 24 and the vertical leg matches the inside height of the front leg 22, thereby closing the gap between the butt jointed forms. Compression is also maintained as above. During the insertion process no ancillary tools are required for either angle 32 or 34, as the corner is started and forced into squareness, also the insulation barrier 30 has a memory when separated. Adhesive may be added during this assembly process, but is unnecessary for proper stability of the form.

Stakes 36, well known in the art, are utilized to hold the form to the ground and maintain the forms position when concrete is poured within the outline. These stakes 36 are made of wood with the bottom end cut to a point and are positioned on the outside of the form. A wire form stake clip 38 holds the stake 36 tightly against the form. One end of the clip 38 corresponds in shape to the sheath vertical back 26, top 24, and front 22, with an angular offset parallel to said sheath 20 front leg 22. The other end, or bottom portion, is angularly disposed even with the bottom of the front leg 22 extending upward parallel with the sheath 20. This clip 38 compressibly secures the stake 36 to the metallic protective sheath 20 at the front leg 22. The top of the clip is compressibly slid over the top of the sheath 20 and the bottom is impinged into the barrier 30 slideably holding the stake 36 closely against the sheath 20. The use of the clip 38 allows the stake 36 to be initially set into the ground and the form to be easily and conveniently locked to the stake 36 by the clip 38. When the concrete is poured and hardens the wire form clip 38 and stake 36 are removed. The barrier 30 and sheath 20 then become an integral part of the structure.

Figure 10:
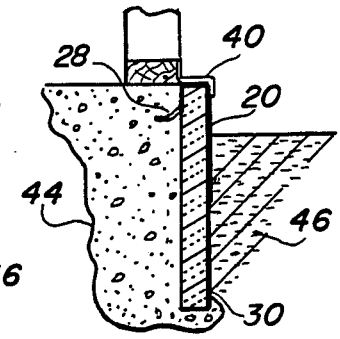
FIG. 10 is a fragmentary cross-sectional view of the insulated concrete form illustrating the sill plate water barrier installed thereupon.
Figure 11:
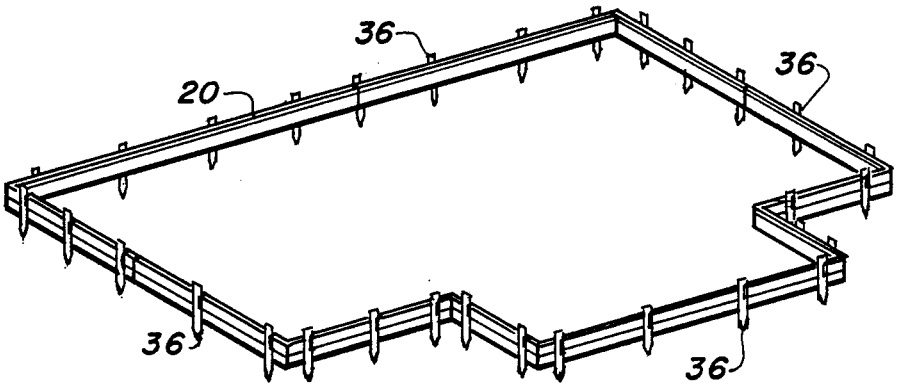
FIG. 11 is a partial isometric view of the insulated concrete form as it would be assembled ready for processing, including butt joints and corners, however, removed from the ground.

To maintain a water barrier, a metallic sill plate 40, pictorially illustrated in FIG. 10, is added to the structure after the concrete is hardened and the stakes 35 are removed. This sill plate 40 is of the same material as the sheath 20 and is in a "Z" configuration. In a building using a slab floor construction, a wood plate 42 is attached around the periphery of the slab upon which the wall is formed. This sill plate 40 is attached to the wooden plate 42 and rests on the top 24 and front 22 of the sheath 20. Again, adhesive or waterproofing mastic may be applied, if desired, to the interface. The purpose of this member is to prevent water, or moisture in various forms, from penetrating the structure.

Figure 6:
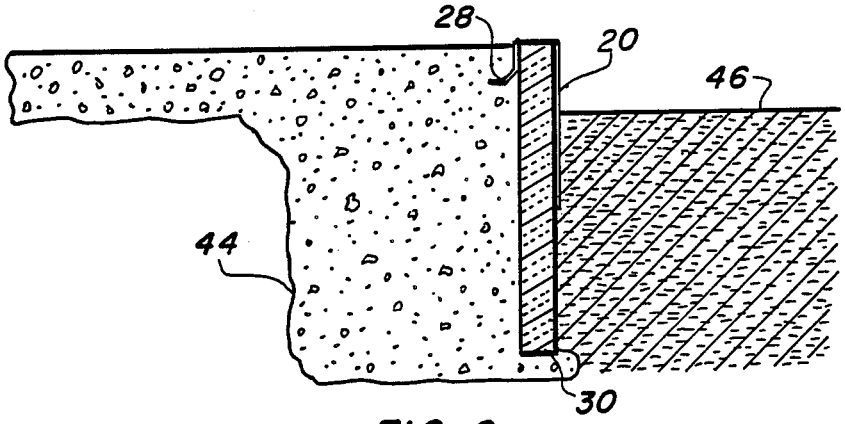
FIG. 6 is a cross-sectional view of the preferred embodiment including the soil, slab floor and footing.
Figure 7:
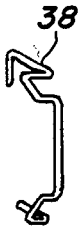
FIG. 7 is a partial isometric view of the wire form stake clip removed from the invention for clarity.
Figure 8:
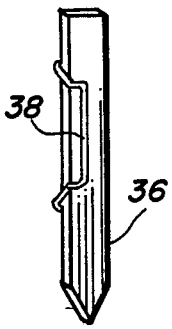
FIG. 8 is the front side of a stake with the wire form clip installed completely removed from the assembly.
Figure 9:
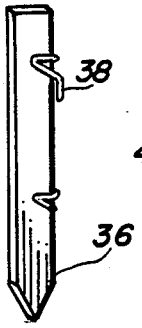
FIG. 9 is the rear side of the above stake.

FIGS. 6 and 10 illustrate the position of the structure in relation to the concrete slab floor and footing 44, and the adjacent earth 46. It will be noted that after the concrete has set and hardened the entire composite assembly, except for the stakes 36 and wire form 38, become an integral part of the floor. Not only does the concrete adhere to the surface of both the sheath 20 and barrier 30, but also to the angular locking flange and bug barrier 28 which is persistently secured within the aggregate. The top of the form is planar with the horizontal surface of the slab completing the structure in that phase of the construction process.

The methods described above for a slab floor are basically the same for a stem wall insulation type of construction, with only the configuration varying slightly.

The steps of constructing a floor using this method of forming include: forming a metallic protective sheath 20 in linear shape, as previously described, slitting rigid block foam into a rectangular shaped insulating barrier 30, heating and spraying adhesive into corresponding areas of the sheath 20 and insulating barrier 30, nesting and joining them together by rolling.

The corners are made by notching one of the ends of the sheath 20 and inserting a corner splice 32 into both open ends. Likewise, a splice in a straight run of forming is made by inserting a splice angle 34 into each butted end creating a structural joint.

Stakes 36 are then positioned around the outer periphery of the unpoured slab and the form is compressibly secured to the inner side of the stake 36 by means of the stake clip 38.

It will be observed that with this type of concrete form, various periphial outlines may be obtained as internal or external corners may be angularly provided, also straight long runs are easily accomplished with the splice joint thus described.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the claims.

I claim:

1. An insulated concrete form for slab flooring comprising:

(a) a metallic protective sheath in linear form having a vertical front leg, a horizontal top, a vertical back, and an angular locking flange and bug barrier;

(b) an insulated barrier of rigid block foam in linear rectangular shape having a front, back, top, and bottom, partially contiguous on the front with said sheath vertical front leg, the top contiguous with said sheath horizontal top, and the upper portion of the back contiguous with said sheath vertical back, all being in intimate contact;

(c) adhesive bonding said protective sheath to said insulated barrier in constant relationship defining a self-contained permanent form to receive concrete in the liquified state when poured into a slab floor configuration becoming an integral part of the periphery when the concrete is solidified with said angular locking flange and bug barrier secured within the concrete and the top planar with the horizontal surface of the slab; and, (d) an angular corner formed by notching said sheath horizontal top, vertical back, and angular locking flange of one linear form in such a manner as to abut with an unnotched form at right angles having said sheath covering the entire corner without overlapping or exposing said insulated barrier.

2. An insulated concrete form for slab flooring comprising:

(a) a metallic protective sheath in linear form having a vertical front leg, a horizontal top, a vertical back, and an angular locking flange and bug barrier;

(b) an insulated barrier of rigid block foam in linear rectangular shape having a front, back, top, and bottom, partially contiguous on the front with said sheath vertical front leg, the top contiguous with said sheath horizontal top, and the upper portion of the back contiguous with said sheath vertical back, all being in intimate contact;

(c) adhesive bonding said protective sheath to said insulated barrier in constant relationship defining a self-contained permanent form to receive concrete in the liquified state when poured into a slab floor configuration becoming an integral part of the periphery when the concrete is solidified with said angular locking flange and bug barrier secured within the concrete and the top planar with the horizontal surface of the slab; and, (d) an angular corner formed by notching said sheath horizontal top, vertical back, and angular locking flange of one linear form in such a manner as to abut with an unnotched form at right angles having said sheath covering the entire corner without overlapping or exposing said insulated barrier; and (e) a metallic corner splice angle having two flat surfaces at right angles forceably embracing the interface between said sheath vertical leg and said insulated barrier being the same width as said sheath vertical leg and smaller in length creating a structural corner when inserted therebetween reinforcing the formed junction.

3. An insulated concrete form for slab flooring comprising:

(a) a metallic protective sheath in linear form having a vertical front leg, a horizontal top, a vertical back, and an angular locking flange and bug barrier;

(b) an insulated barrier of rigid block foam in linear rectangular shape having a front, back, top, and bottom, partially contiguous on the front with said sheath vertical front leg, the top contiguous with said sheath horizontal top, and the upper portion of the back contiguous with said sheath vertical back, all being in intimate contact;

(c) adhesive bonding said protective sheath to said insulated barrier in constant relationship defining a self-contained permanent form to receive concrete in the liquified state when poured into a slab floor configuration becoming an integral part of the periphery when the concrete is solidified with said angular locking flange and bug barrier secured within the concrete and the top planar with the horizontal surface of the slab; and, (d) an angular corner formed by notching said sheath horizontal top, vertical back, and angular locking flange of one linear form in such a manner as to abut with an unnotched form at right angles having said sheath covering the entire corner without overlapping or exposing said insulated barrier;

(e) a metallic corner splice angle having two flat surfaces at right angles forceably embracing the interface between said sheath vertical leg and said insulated barrier being the same width as said sheath vertical leg and smaller in length creating a structural corner when inserted therebetween reinforcing the formed junction; and, (f) a splice joint formed by butting a pair of insulated concrete forms end to end and attaching a metallic straight splice angle having a top leg and a vertical leg forceably embracing the interface between said sheath top and sheath vertical front leg being the same width as the inside of said sheath top and front leg creating a structural joint when inserted therebetween reinforcing the formed junction.

* * * * *